US006926648B2

(12) United States Patent
Capizzo

(10) Patent No.: US 6,926,648 B2
(45) Date of Patent: Aug. 9, 2005

(54) SELF-SPOTTING BENCH PRESS APPARATUS FOR PROGRESSIVE LIFT DISTANCE TRAINING

(75) Inventor: Kevin Capizzo, Sterling Heights, MI (US)

(73) Assignee: Concepts 2000, Inc., Sterling Heights, MI (US)

( * ) Notice: Subject to any disclaimer, the term of this patent is extended or adjusted under 35 U.S.C. 154(b) by 374 days.

(21) Appl. No.: 10/320,573

(22) Filed: Dec. 16, 2002

(65) Prior Publication Data

US 2003/0114277 A1 Jun. 19, 2003

Related U.S. Application Data

(60) Provisional application No. 60/341,630, filed on Dec. 17, 2001.

(51) Int. Cl.[7] ..... A63B 21/00
(52) U.S. Cl. ..... 482/104; 482/106; 482/142
(58) Field of Search ..... 482/104–108, 482/8, 4, 93

(56) References Cited

U.S. PATENT DOCUMENTS

| | | | | |
|---|---|---|---|---|
| 4,249,726 A | | 2/1981 | Faust | |
| 4,799,672 A | | 1/1989 | Barrett | |
| 5,151,072 A | * | 9/1992 | Cone et al. | 482/104 |
| 5,468,203 A | * | 11/1995 | Okonkwo | 482/104 |
| 5,779,602 A | * | 7/1998 | Rodriguez | 482/104 |
| 5,989,166 A | | 11/1999 | Capizzo et al. | |
| 6,558,299 B1 | * | 5/2003 | Slattery | 482/93 |
| 6,746,379 B1 | * | 6/2004 | Brawner | 482/104 |

* cited by examiner

*Primary Examiner*—Jerome W. Donnelly

(57) ABSTRACT

A self-controlled modular bench press apparatus for progressive lift distance training including a pair of stands each with an upper translating assembly for vertical, incremental movement selectable by the user during exercise with no barbell attachments. The stands fit underneath the barbell and accommodate off-center loading of the barbell. Each stand includes a linear motion actuator to provide for the vertical movement and a quick connect/disconnect controller enables the user to provide input to each electrically controlled linear motion actuator to translate the upper translating assembly in an independent but parallel manner.

19 Claims, 6 Drawing Sheets

SELF-SPOTTING BENCH PRESS APPARATUS FOR PROGRESSIVE LIFT DISTANCE TRAINING

RELATED APPLICATIONS

This application claims the priority of Provisional Patent Application Ser. No. 60/341,630 filed Dec. 17, 2001 and entitled Self-Spotting Bench Press Machine.

BACKGROUND OF THE INVENTION

The goal of an athlete that performs in free weight powerlifting competitions is to be able to out-lift the other competitors in various traditional free weight exercises that include the standard flat bench press exercise. One way in which powerlifters train to increase their bench press capability is by incorporating 2"×4" wood boards into their training routine. Before the bench press lift is started, the powerlifter loads the barbell so it is weighted heavier than what he can normally lift for a complete single repetition. He then places a stack of boards on top of his chest while he is in the lying position. He then lifts the barbell from the bench support braces and lowers the barbell until it touches the top board of the stack. Once the barbell touches the top board, the lifter then raises and places the barbell back onto the support braces. This routine is practiced for several exercise sessions until raising the heavier weighted barbell becomes easy and the lifter has become physically stronger. At this point, the powerlifter will remove the top board of the total number of boards that he had been placing on their chest prior to the bench press exercise. When the lifter lowers the same heavy barbell, he will lower it to the next top board of the shortened stack. This removal of boards creates a progressive lift distance type of training where the lifter attempts lifts over shorter distances that progressively become longer. The distance increases gradually as the lifter removes the boards and the distance from his arms completely extended holding the barbell to the top board of the stack becomes longer. The addition and gradual removal of boards will continue during the workouts over a period of weeks or months in a progressive manner until the lifter finally removes the last board of the stack and he can complete a full bench press repetition by lowering the heavy barbell to their chest and lifting it back onto the top of the bench support posts. The lifter can now perform a full repetition lowered to his chest with the heavier barbell than what he could lift before boards had been incorporated into the training sessions.

Although incorporating the stack of boards or "using the boards," as it is known in the field, is an effective and proven way for powerlifters to increase their strength and bench press ability, there are several disadvantages realized when the lifter simply places a stack of wood boards on top their chest prior to performing the bench press such as safety and adjustability. Unfortunately, the stack of wood boards is unstable and the lifter must utilize a spotter to hold the boards in place while the lifter performs the lift and to assist the lifter in raising the barbell if the lifter can't raise the barbell from the top board back onto the barbell support braces. Therefore, this type of training routine is typically considered too dangerous for a lifter to attempt unassisted and thus limits the time and place when it can be performed. Since 2"×4" wood boards are normally used in this type of training, the lifter can only increase or decrease the height of the stack in 2" increments. There are plenty of times when the lifter would like to be able to adjust the height of the stack in increments less than 2" based on how strong or weak they are feeling on that particular day. However, utilizing boards thinner than 2" would be considered too cumbersome, unstable, and dangerous.

It would therefore be useful to have a self-controlled device to enable a powerlifter to increase his bench press capability by allowing them to train in a progressive, incremental fashion as is done by placing a stack of wood boards on their chest and incrementally removing the boards during bench press training as described above. The self-controlled device would allow the powerlifter to safely and more efficiently achieve the same effect of using the wood boards by enabling them to perform the exercise unassisted and giving them the capability of progressing the lift distance in increments smaller or larger than 2" while the exercise is in progress. However, for the device to be truly safe, effective and desirable, it must enable a means for incremental and selectable lift/lower and hold in place of the barbell while performing the exercise with no barbell attachments. Powerlifting is a very mentally challenging sport and any lift mechanism that requires permanent attachments to the barbell would be distracting and be deemed undesirable.

Product marketability of the invention is as important as its functionality. Not only must the invention provide a means for selectable, incremental lift/lower and hold in place of the barbell during exercise with no barbell attachments to simulate the wood board training technique as described, but, the invention also must do it in a manner that is safe, affordable, compact, portable, relatively light and easy to hand carry to a basement where most powerlifters train. The device should also be inexpensive and easy to ship, very simple to set-up and operate and have a user-friendly and un-intimidating appearance with very minimal user assembly requirements. The device should also utilize a common power source such as 110V AC as found in most households and gyms and be compatible with most existing weight benches since powerlifters typically have their own favorite bench. The invention should also be robust with very little maintenance requirements with the user being able to perform the maintenance if any is ever required.

Numerous patents relate to self-spotting bench press machines, but very few if any have ever been commercially successful over a long period because none provide for all the functionality and marketability features mentioned above.

For example, U.S. Pat. No. 5,989,166 describes the advantage of a spotter device that is adjustable during exercise and permits the vertical distance to be selected as needed during exercise. The reference has a drawback, however, in that permanent attachments to the barbell are used as part of the lift mechanism which can potentially distract the user. Further, the lift mechanism requires a large overhead structure preventing the device from being truly portable and easy to move or set-up.

SUMMARY OF THE INVENTION

The present invention provides a self-controlled system, which permits powerlifting athletes to perform bench press strength training safely by enabling them to simulate the effect of having a spotter and a stack of wood boards on his chest for the purpose of progressive lift distance training. The self-controlled system does not require any barbell attachments. Rather, the present invention includes a pair of stands each with an upper translating assembly for vertical, incremental movement. Each stand includes a horizontal support member for supporting and translating up or down a weighted barbell, and a lower stationary base assembly for receiving the upper translating assembly. The lower stationary base includes a top plate, lower base, interconnecting vertical stanchions, and lower stabilizing members. Interconnecting the lower stationary base assembly and the upper translating assembly is a linear motion actuator that can extend or retract the upper assembly based on the input that the user provides via a dual motion system controller.

The linear motion actuator can be chosen from the field of electric, hydraulic, pneumatic or other type of powered linear motion actuator. The intent of the invention is not to limit itself to a specific actuator but to be able to incorporate the most efficient and economical motion system available as motion system technology improves over time. Whichever linear motion actuator is used, it preferably provides for the functionality, safety, and marketability requirements as stated. The linear motion actuator ideally includes a brake to prevent the system from back driving and to enable the upper support members to hold the weighted barbell in place when the linear motion system is not activated thus allowing the user to simulate wood boards being stacked on his chest, as commonly used in powerlifting training, for the purpose of progressive lift distance training.

As a safety precaution, the stands are preferably sized to accommodate a standard size weight bench so the barbell will be safely supported above the user's chest when the actuators are at the lowest possible height setting. The upper translating assembly provides for ample space in which the user can utilize to place the barbell upon if he should get stuck when attempting heavy lifts. The upper assembly allows for barbell loading off-center from the line of motion of the actuators by utilizing steel shafting that translates through bearings located within the lower stationary base.

While actuators are generally made to accommodate vertical loads only with no offset bending moment loads, shafting and bearings are provided to accommodate any bending moments generated by offset loading. In order to keep the shafting and bearings as small and efficient as possible, the upper assembly includes triangular wedge-shaped pieces in order to keep the barbell offset only to a point where the bending moment loads will not exceed the shafting and bearing allowable stress level when the barbell is heavily weighted up to, for example, 1000 lbs. Models of varying capacity can be created by utilizing bearings and shafting sized to accommodate the specific model load rating. The rating can be anywhere in the range of 100 to 1000 lbs. Having models available that vary in price based on the load capacity will increase the invention marketability. The triangular wedge-shaped pieces also act as a safety feature by keeping the barbell towards the center of the stands and not allowing it to roll off the ends of the upper assembly.

Since the invention uses two independent actuators for compactness and safety, a dual actuator controller is included as a foot pedal control apparatus in which the user can use to activate both stands in either an up or down direction via separate up and down foot pedals. The control apparatus includes two switches and is wired in such a way to enable the actuators to operate in parallel fashion. When the actuators operate in parallel, they are allowed to reach their upper and lower limits independently thus creating a self-leveling affect should the actuators start to translate out of sync with one another. The controller also includes a toggle mechanism that prevents dual inputs to the actuators, which could cause the actuators to burnout. Uniquely designed torsion springs keep the pedals held in position thus preventing unintended inputs.

The present invention can be used in connection with an adjustable convex mirror with a magnetic base which the user can attach to a bench to allow the user to see the foot pedal controller while they are in position lying on the bench performing the exercise. Also included is a means to easily connect or disconnect the stands from the foot pedal thus allowing for the three individual pieces to be shipped and handled separately with the individual stands weighing less than 90 pounds each and the foot pedal controller weighing less than 25 pounds. The user will be able to easily hand carry the items to a basement, or store them in a small closet. This easy carry, set-up, take down, and store feature along with the invention's functionality will greatly add to the inventions marketability over the prior art. A cord cover can also be included to keep the user from possibly tripping over the foot pedal power and control cords.

Other objects and advantages of the invention will become apparent upon reading the following detailed description and appended claims, and upon reference to the accompanying drawings.

BRIEF DESCRIPTION OF THE DRAWINGS

For a more complete understanding of the invention, reference should now be made to the embodiments illustrated in greater detail in the accompanying drawings and described below by way of an example of the invention.

In the drawings.

DETAILED DESCRIPTION OF THE INVENTION

Figure 1:
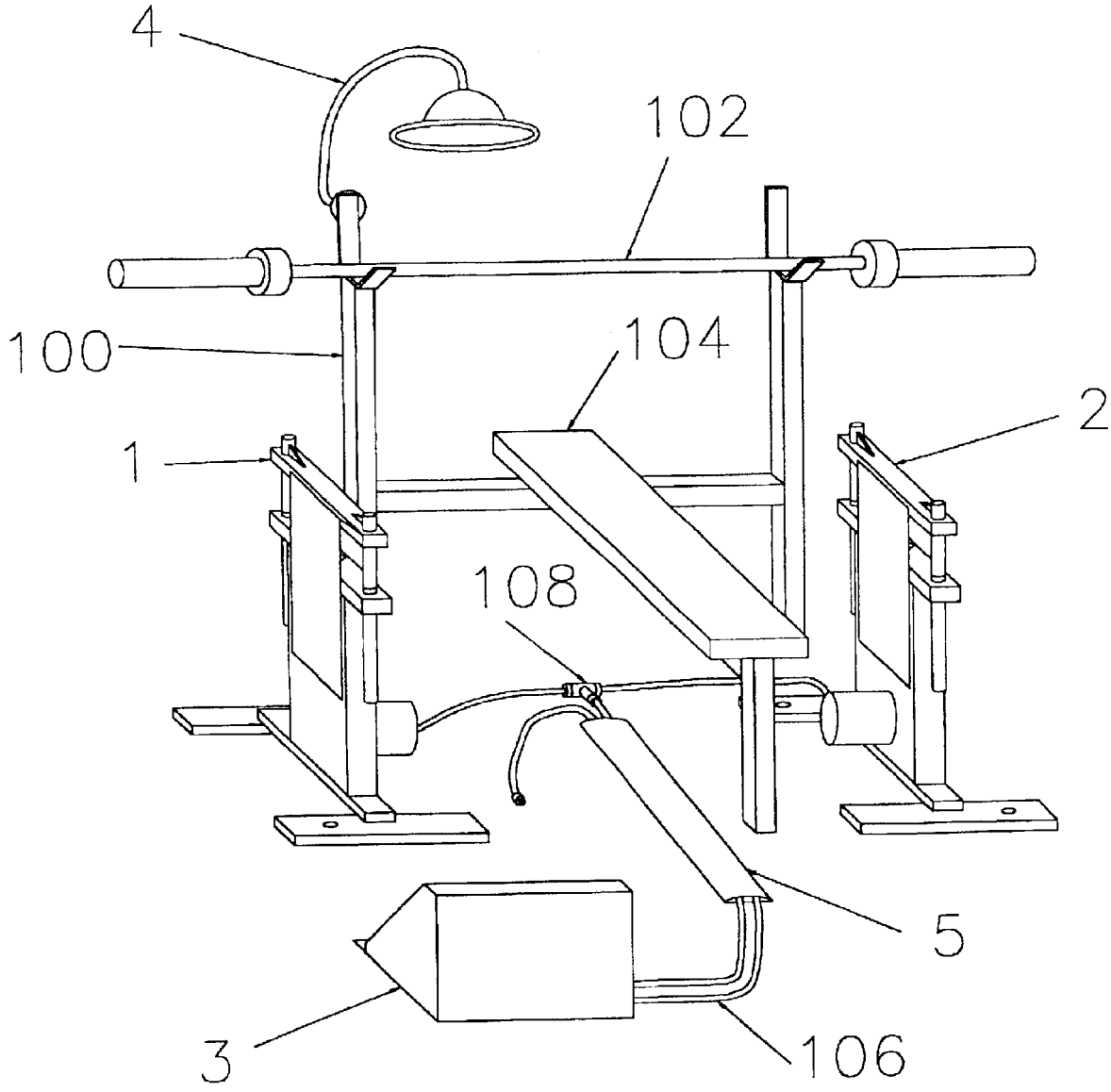
FIG. 1 is a perspective view of the first embodiment of the invention along with a typical bench press shown for reference.

The present invention, as shown in FIGS. 1–6, is a self-controlled system, which enables powerlifting athletes to perform bench press exercise safely and effectively by enabling them to simulate the effect of having a spotter and a stack of wood boards on their chest for the purpose of progressive lift distance training. Referring to FIG. 1, the invention includes two safety stands 1 and 2 that can be placed on either side of an existing bench 104 of a bench press 100 that will provide for selectable, incremental raising or lowering and holding in place of the barbell as determined by user input during the time of exercise with no requirement for barbell attachments. Two safety stands 1, 2, each with its own actuator, attributes to the inventions safety through redundancy and portability by being able to be placed directly under the barbell 102 with a maximum height of not more than 26 inches in the retracted position. The stands are sized so that they will hold the barbell is in place above the user when the actuators are at their lowest setting as an additional safety feature. A foot pedal "up" and "down" dual actuator controller 3 can be placed at the end of the bench 104 in the proximity of the user's feet allows for synchronous parallel actuator control, and a magnetic base convex mirror 4 that can be attached to the bench press 100 to enable the user to see the foot pedal when lying on the bench performing the exercise. The mirror can be chosen from the most effective for this application known in the art. A set of four-wire control cords 106 connected by a quick-connect T-fitting 108 sends an electric control signals from the foot pedal UP and DOWN controller 3 to the safety stands 1, 2. This easy connect and disconnect feature allows the safety stands 1, 2 and foot pedal controller 3 to be shipped and handled separately and for set-up and connecting in less than 10 minutes. A cord cover 5 can be used to cover the foot pedal control cord and power cord to minimize the likelihood of tripping over the cords when moving around the area of the bench. The cord cover 5 can be chosen from a variety of manufacturers of rubber components and is preferably five feet in length with a center channel of at least one inch by three-quarter inch in sectional size. One example of a suitable cord cover is the Hubbell part number FT4BK5.

Figure 2:
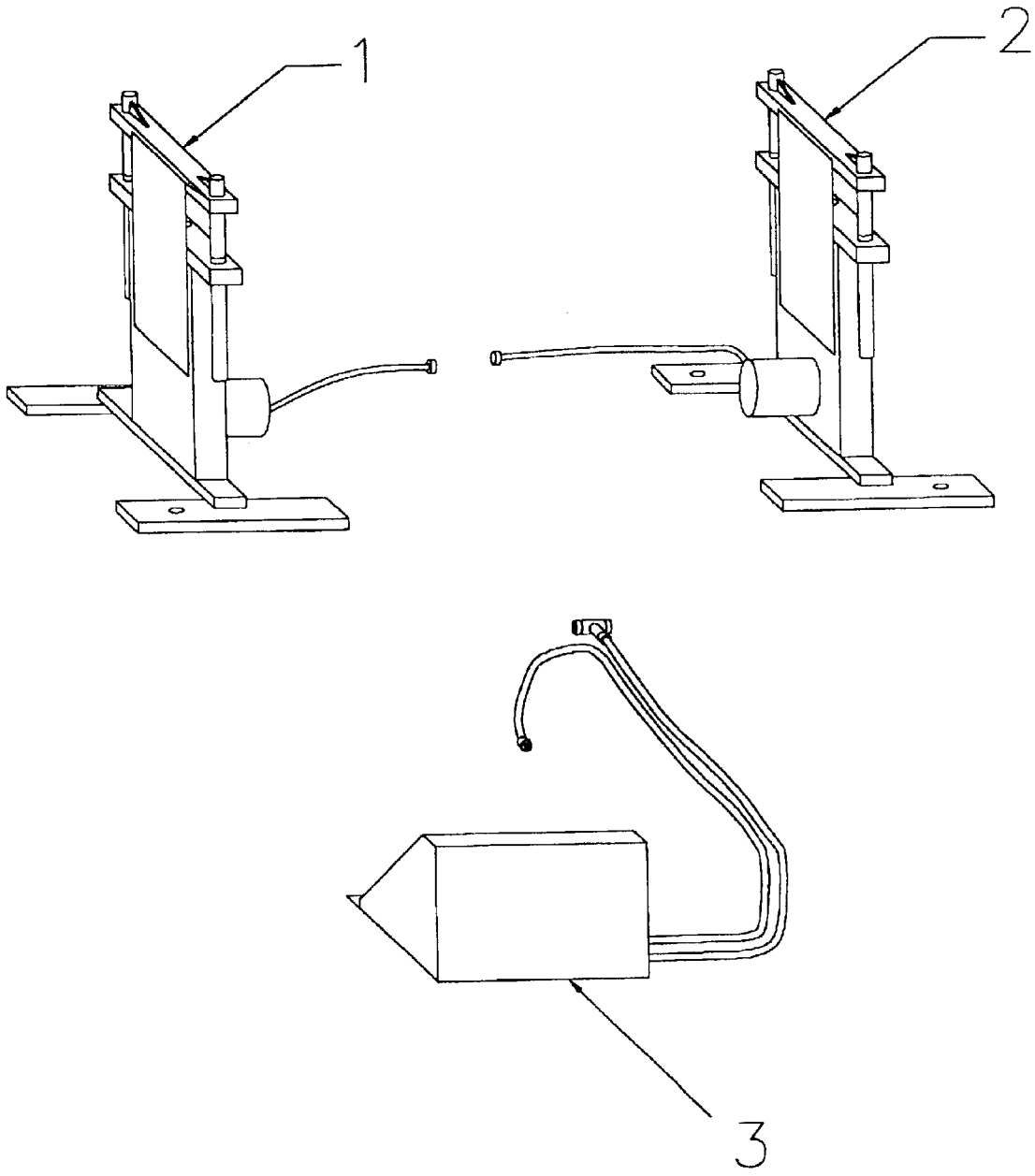
FIG. 2 is a perspective view of several components of the invention.

FIG. 2 shows the invention as its individual components prior to user set-up. It can be seen from this figure that the left and right safety stands 1 and 2 can be easily connected and disconnected from the foot pedal controller 3. The implementation of a modular type of component design allows for no single component of the invention to weigh over 90 pounds with no user assembly required other than connecting the cords. Through the use of two individual safety stands, each with its own actuator controlled in a parallel manner, FIG. 2 shows how the invention achieves the marketability requirement of being compact, portable, relatively light and easy to hand carry to a basement where most powerlifters train, inexpensive and easy to ship, very simple to set-up and operate and have a user-friendly and unintimidating appearance with very minimal user assembly requirements. The dual actuator foot pedal controller 3 utilizes a common power source such as 110V AC as found in most households and gyms. The invention is compatible with most existing weight benches since powerlifters typically have their own favorite bench. The magnetic base convex mirror 4 and cord cover 5 as shown in FIG. 1 can also be provided as separate components attributing to the inventions portability and versatility.

Figure 3:
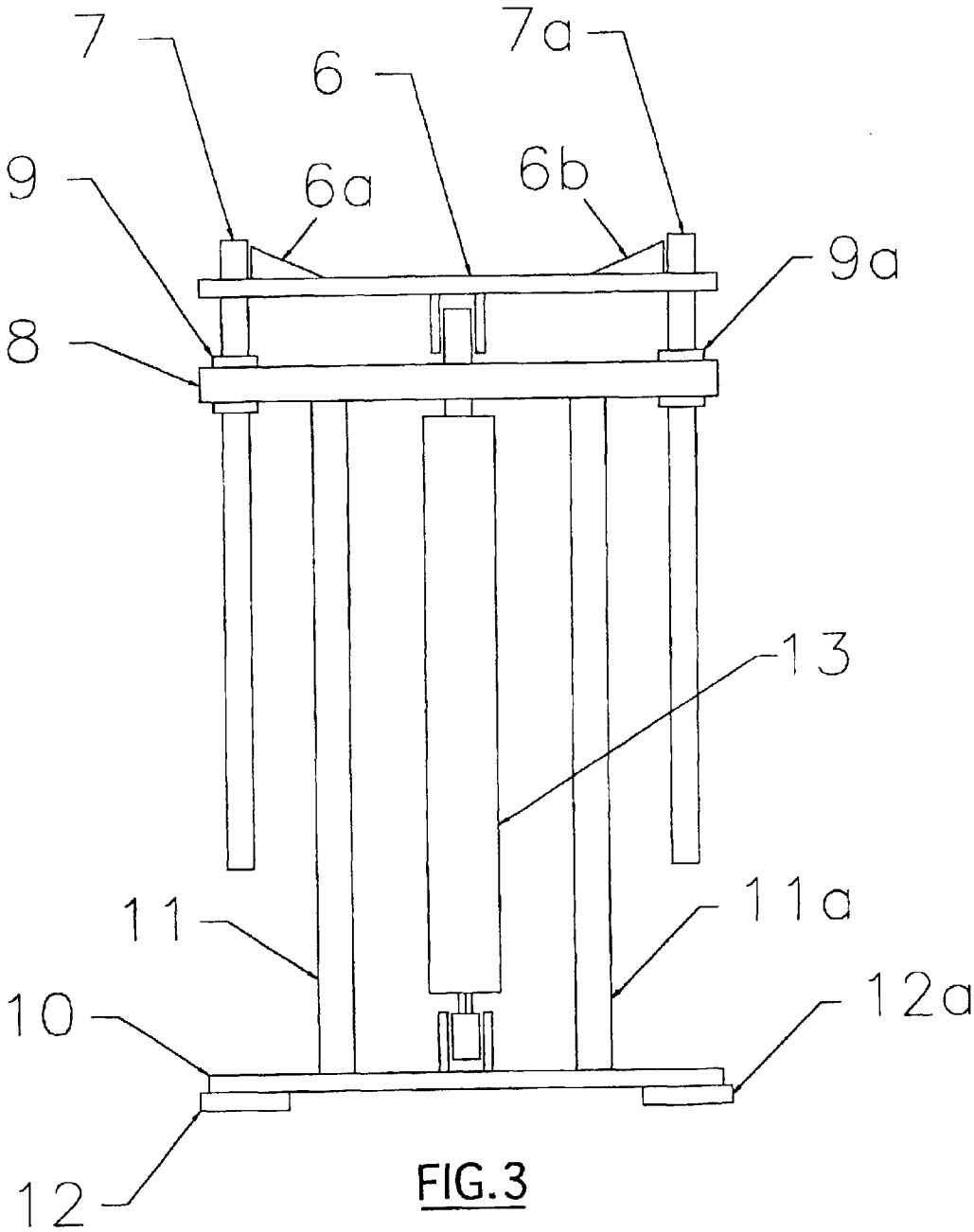
FIG. 3 is a side view of a safety stand with lift mechanism in the retracted position.

FIG. 3 is a side view of one of the safety stands 1, 2 of FIG. 2. Each safety stand includes an upper assembly for vertical, incremental movement comprising a horizontal support member 6 and control rods 7, 7*a* used for supporting the weighted barbell. The horizontal support member 6 essentially acts as the top "board" as described earlier. Horizontal support member 6 preferably has at least six inches of flat area for barbell placement and at least 12 inches of overall length for barbell placement for safety. Attached to either end of the horizontal member 6 are steel rods 7 and 7*a*. The steel rods preferably have a 12-micron or smoother finish. The upper portions of the horizontal member 6 includes a barbell centering mechanism comprising triangular wedge-shaped pieces 6*a* and 6*b* which keep the barbell offset only to a point where the bending moment loads will not exceed the shafting and bearing allowable stress level when the barbell is heavily weighted up to, for example, 1000 lbs. The triangular wedge-shaped pieces also act as a safety feature by keeping the barbell towards the center of the stands and prevent it from rolling off the ends of the upper assembly. Wedge-shaped pieces 6*a* and 6*b* can be fabricated from any material as long as the material meets the size, strength and cost requirements of this application. The present invention utilizes cold-drawn steel type 1018 for the wedge-shaped pieces.

Each stand also includes a lower stationary base assembly for receiving the upper translating assembly. The lower stationary base assembly includes a top plate 8 with bearings installed at either end 9 and 9*a* for supporting the steel control rods 7, 7*a* and allowing frictionless vertical movement of the upper assembly. The lower stationary base also includes a base plate 10. Connecting the top plate with the base plate are two vertical members 11 and 11*a*. To add support and stability, two rectangular foot members 12 and 12*a* with bolt-holes for bolting to the floor are attached to the base plate 10. All structural members of the lower stationary base assembly are preferably made from steel but other materials such as aluminum or strong plastics may also be used. Interconnecting the lower stationary base assembly and the top vertical movement assembly is an electronically controlled linear motion actuator 13 that can extend or retract the upper assembly based on the input that the user provides via the foot pedal dual controller. The linear motion actuator can be chosen from the field of electric, hydraulic, pneumatic or other type of powered linear motion actuator. A Duff-Norton electric actuator model number HMPB 6905 can be used, for example. Whichever type of linear motion system is used, the system must incorporate a brake which will allow the system to hold the barbell in place without back driving when the linear motion system is not activated to translate up or down by the user during exercise. The actuator should allow for modular type of system connection and all the other invention marketability requirements stated earlier. Most linear motion systems cannot handle offset loads that will happen when the barbell in not placed on the upper horizontal support member 6 directly above the centerline of the actuator. If this happens on the present invention, the steel rods sliding through the bearings will react any offset moment generated and will allow the actuator to fully extend or retract without binding or jamming.

Figure 4:
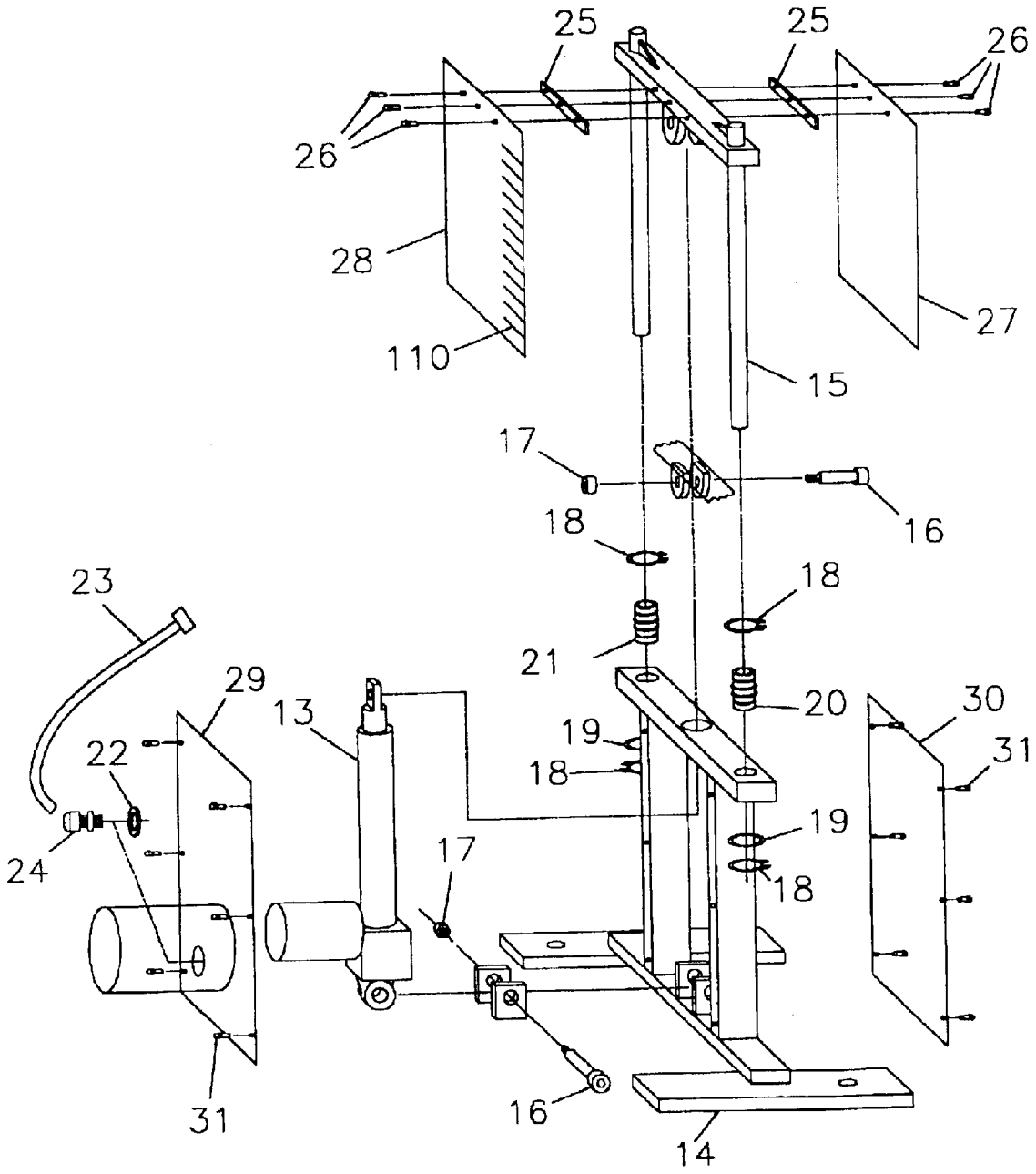
FIG. 4 is a perspective assembly view of the safety stands of FIG. 2.

FIG. 4 is a perspective view of the safety stand assembly. The view shows how the linear motion actuator 13 can be installed between the lower stationary base assembly 14 and the upper translating assembly 15. The actuator is fastened into place with a shoulder screw 16 and locknut 17. Retaining rings 18 are used to lock into place standard size bearing 20 and slightly oversize bearing 21. The combination of a standard size bearing and an oversize bearing is used to accommodate any non-parallelism of the shafts of the upper translating assembly. The bearings can be better fitted dimensionally with the lower stationary base assembly by using shims 19. The lower stationary base cavity for the actuator can be completely enclosed for safety using steel cover panels 29 and 30. A four wire quick connect control cord 23 can be routed through the inside cover panel 29 for permanent connection to the actuator and allow for a quick connect/disconnect to the foot pedal control as part of the inventions modularity electrical connection design feature. The control cord can be routed through the cover panel using cable grommet 24 and cable grommet lock washer 22. The cover panels can be fastened to the lower stationary base with sheet metal screws 31. Cover panels 27 and 28 are attached to the upper translating assembly to cover the actuator as it vertically moves the upper assembly when actuated during exercise by the user. Spacers 25 are used to offset the panels for clearance. Locking screws 26 are used to attach the cover panels to the upper translating assembly. A graduated scale 110 in the form of markings or a decal can be included on the cover 28 so the user can keep track of the vertical adjustment for the purpose of progressive lift distance training described earlier.

Figure 5:
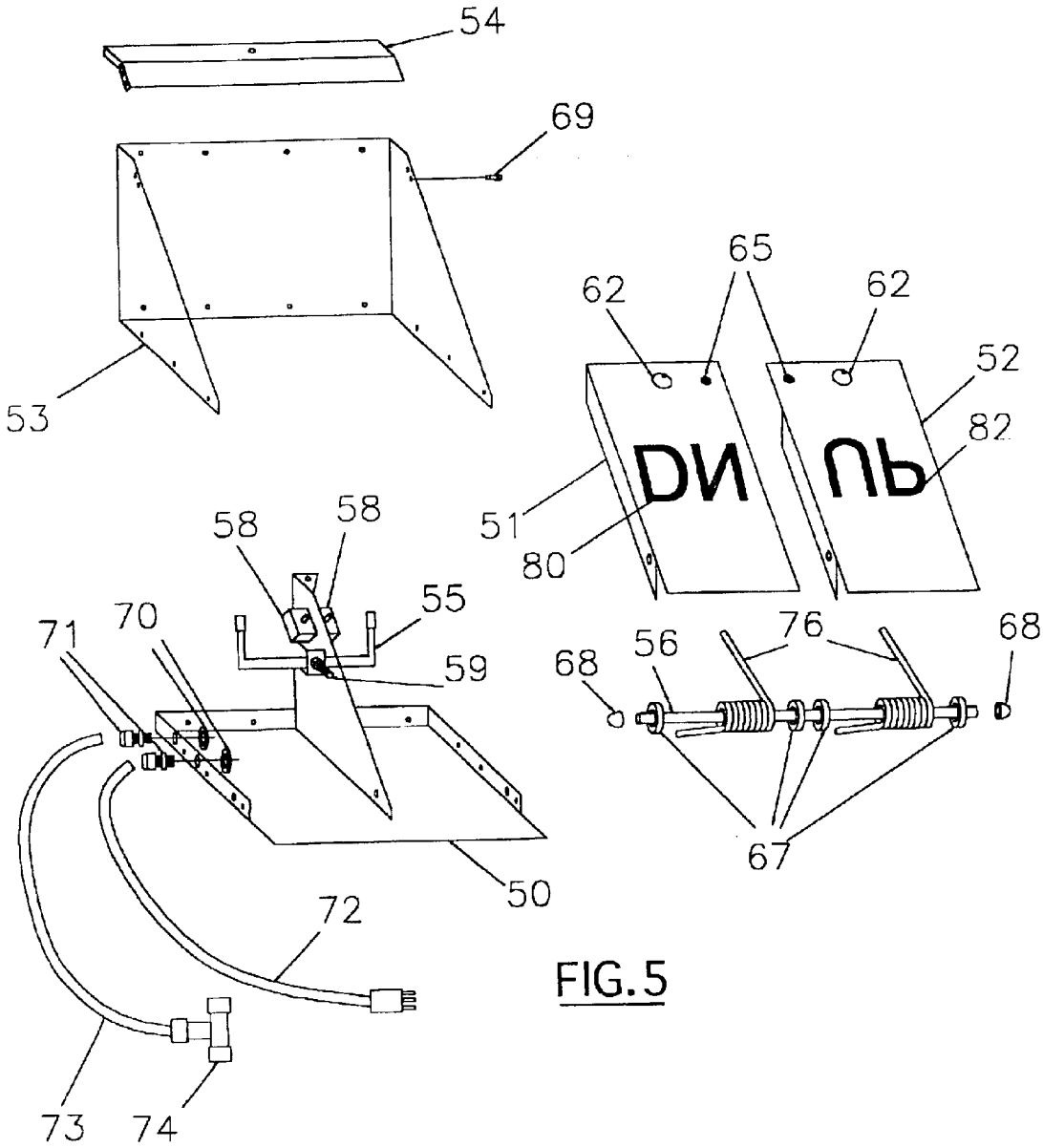
FIG. 5 is a perspective view of the dual actuator foot pedal controller assembly.

FIG. 5 is a perspective assembly view of the dual actuator foot pedal controller assembly. The foot pedal base 50 is used as a platform for containing contact switches 58. Both switches are in the normally open position. When the "UP" foot pedal 52 is pressed by the user, an electric current is passed from the 110V AC power cord 72 to the four-wire control cord 73 black wire which causes both safety stand actuators to extend and raise the barbell. When the user presses the "DN" foot pedal 51, the electric current is passed from the power cord 72 to the control cord 73 red wires causing both safety stand actuators to retract and lower the barbell. A toggle arm 55 is used to keep the switches from being pressed simultaneously and sending current to both the black and red wires at the same time that could cause the actuators to burnout. The foot pedals are attached to the base by the shaft 56. Spacers 67 are used to maintain clearance to the base. Torsion springs 76 are placed around the shaft and keep the foot pedals from contacting the switches not intended by the user. Locking caps 68 keep the shaft secured to the base. Screws 65 are threaded through the pedals and engage the plungers of the switches 58. Rubber bumpers 62 keep the foot pedals orientated in a favorable position with base 50 and cap 54. The cap 54 is attached to the cover 53 by screws 69. The same type of screws 69 can be used to attach the cover 53 to the base 50. Power cord 72 and control cord 73 are held in place within the base 50 by cable grommets 71 and grommet locking rings 70. T-fitting 74 is used as a fast and simple means of connecting/disconnecting the foot pedal control cord 73 to the safety stand control cords 23 of FIG. 4 as part of the inventions modular design.

Figure 6:
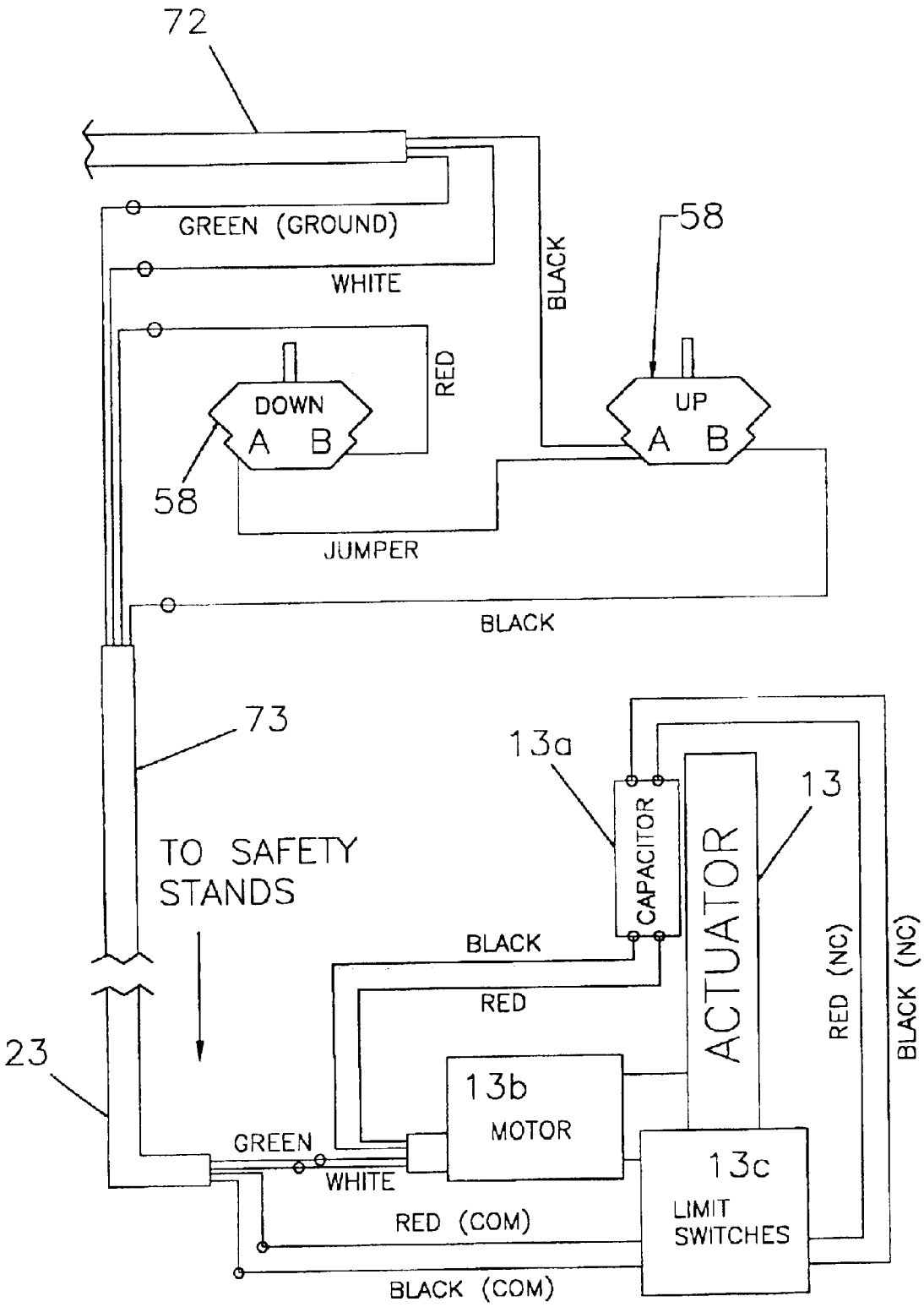
FIG. 6 is a schematic view of the control circuit of the present invention.

FIG. 6 is a schematic view of the control circuit of the present invention and shows how electric current is controlled from power cord 72 through the foot pedal control cord 73 and safety stand control cords 23. Normally open switches 58 can be closed by using the foot pedal controller as described above that will transmit current through the black wires to extend or through the red wires to retract the actuator 13. FIG. 6, along with the foot pedal controller description above, should make it apparent to anybody skilled in the art as to how the present invention will send electric input to each electrically controlled linear motion actuator motor 13*b* to translate the upper translating assembly in an independent, synchronous, parallel manner which will allow each actuator to reach its travel limit independently as controlled by independent adjustable limit switches 13*c*. This is an important self-leveling feature since the motors will travel at slightly different rates due to actuator build variation and possible differences in load distribution between the safety stands. Capacitor 13*a* may also be included in the circuitry if required. Inverted and reversed "UP" and "DN" labels 80 and 82 will look correct when viewed from mirror 4 of FIG. 1.

It should be clear at this point to realize how the present invention will enable a powerlifter to safely and efficiently simulate the effect of using the wood board training method as described earlier. To clarify further, the user will simply lie in position on the bench and activate the linear motion actuators via the foot pedal dual controller to raise or lower the upper assembly of the safety stands to any incremental height above his chest. Once the support members of the upper assembly are raised to the desired height, the user will lift a heavy weighted barbell from the bench support braces and will lower the barbell until it touches the upper support members and then the user will lift the barbell back onto the support braces. Once this lift distance becomes easy to the user, the user will be able to adjust the vertical height of the support members by activating the "down" foot pedal control to any desired incremental height. By this method, the user will be able to simulate the progressive lower and lift training provided by the wood board stack method but in a much safer, convenient, and efficient manner. If the user lowers the heavy weighted barbell to the support members and he does not have the strength to lift the barbell back to the support braces, the user will simply let the barbell rest on the support members and activate the actuators via the "up" foot pedal control to raise the barbell and hold in place at a point where the user will be able lift the barbell back onto the support braces thus simulating a "spotter."

It is also contemplated that the invention could be easily modified dimensionally to accommodate incline and decline bench presses and seated benches used for shoulder press types of exercise. Applying the same type basic type of system architecture could easily be done for spotting of standing types of powerlifting exercises such as the squat. Thus, although the present invention has been described in connection with one constructed embodiment, it should not be limited thereto. Rather, the invention includes all modifications and equivalents as contemplated by the following claims.

What is claimed is:

1. A modular self-spotting assembly for a bench press machine comprising:

a pair of stands for arrangement on each side of the bench press, each stand comprising:

an upper assembly including a horizontal support member and at least one control rod extending down from said horizontal support member;

a lower base assembly including a top plate having corresponding openings formed therein for receiving said at least one control rod, a base plate separated from and in substantially parallel relation to said top plate, and at least one vertical member connecting said top plate and said base plate; and at least one linear actuator connecting the upper assembly and the lower base assembly and adapted to translate the upper assembly with respect to the lower base assembly; and a controller electrically coupled to each of the linear actuators to incrementally adjust the height of each of said stands.

2. An assembly according to claim 1 wherein each of said linear actuators includes a brake to maintain the respective upper assembly at a selected height when the actuator is not activated.

3. An assembly according to claim 1 wherein said horizontal support member includes a barbell centering mechanism for receiving a barbell.

4. An assembly according to claim 3 wherein said barbell centering mechanism comprises two wedge-shaped members arranged at opposing ends of the horizontal support member.

5. An assembly according to claim 1 wherein said lower base assembly comprises a foot member connected to said base plate for increasing the footprint of the stand.

6. An assembly according to claim 1 wherein said top plate includes bearings in each of said openings for receiving said respective control rod.

7. An assembly according to claim 1 wherein the lower base assembly includes a cover panel.

8. An assembly according to claim 1 wherein the upper assembly includes a cover panel.

9. An assembly according to claim 8 wherein the cover panel includes a graduated scale to indicate the relative height of the horizontal support member with respect to the ground.

10. An assembly according to claim 1 wherein each linear actuator can support up to approximately 1000 pounds.

11. An assembly according to claim 1 wherein each linear actuator provides at least 12 inches of vertical, incremental travel.

12. An assembly according to claim 1 wherein said controller includes two-foot switches to indicate desired up and down incremental adjustment, respectively.

13. A spotting assembly for a bench press machine comprising:

two safety stands for arrangement on opposing sides of the bench press, each stand comprising:

an upper assembly including a horizontal support member and two control rods extending down from said horizontal support member, the horizontal support member adapted to receive a barbell on an upper surface thereof;

a lower base assembly including a top plate having two openings formed therein for receiving a corresponding control rod such that said horizontal support member moves in registered relation to said top plate, a base plate separated from and in substantially parallel relation to said top plate, and at least one vertical member connecting said top plate and said base plate; and at least one linear actuator connecting the upper assembly and the lower base assembly and adapted to translate the upper assembly with respect to the lower base assembly; and a controller electrically coupled to each of the linear actuators to incrementally adjust the height of each of said stands.

14. An assembly according to claim 13 wherein said top plate includes bearings in each of said openings for receiving said respective control rod.

15. An assembly according to claim 13 wherein each of said linear actuators includes a brake to maintain the respective upper assembly at a selected height when the actuator is not activated.

16. An assembly according to claim 13 wherein said horizontal support member includes a barbell centering mechanism for receiving a barbell.

17. An assembly according to claim 16 wherein said barbell centering mechanism comprises two wedge-shaped members arranged at opposing ends of the horizontal support member.

18. An assembly according to claim 13 wherein the upper assembly includes a cover panel having a graduated scale to indicate the relative height of the horizontal support member with respect to the ground.

19. An assembly according to claim 13 wherein said linear actuator is an electrical, hydraulic or pneumatic linear actuator.

* * * * *